US006132301A

United States Patent [19]

Kaiser

[11] Patent Number: 6,132,301

[45] Date of Patent: Oct. 17, 2000

[54] AUXILIARY SURFACE TREATING ARRANGEMENT FOR SURFACE TREATING DEVICE

[76] Inventor: Richard A. Kaiser, N84 W28518 Center Oak Rd., Hartland, Wis. 53029

[21] Appl. No.: 09/219,128

[22] Filed: Dec. 22, 1998

Related U.S. Application Data

[63] Continuation-in-part of application No. 08/942,099, Oct. 1, 1997, abandoned.

[51] Int. Cl.[7] ..... B24B 55/02

[52] U.S. Cl. ..... 451/450; 451/344; 451/356; 451/357; 451/446

[58] Field of Search ..... 451/844, 357, 451/356, 446

[56] References Cited

U.S. PATENT DOCUMENTS

| | | | |
|---|---|---|---|
| 4,102,084 | 7/1978 | Bloomquist | 451/357 |
| 4,383,345 | 5/1983 | Alexander | 15/97 |
| 4,523,411 | 6/1985 | Freerks | 451/357 |
| 5,309,594 | 5/1994 | Thompson | 15/97.1 |

FOREIGN PATENT DOCUMENTS

| | | | |
|---|---|---|---|
| 2215293 | 9/1989 | United Kingdom | B60S 3/04 |

*Primary Examiner*—David A. Scherbel
*Assistant Examiner*—Shantese McDonald
*Attorney, Agent, or Firm*—Andrus, Sceales, Starke & Sawall

[57] ABSTRACT

A surface treating device is provided for rotating a primary surface treating arrangement supplied with a surface treating material relative to a working surface. A driving mechanism is provided for rotating the primary surface treating arrangement including a driven output tube operably connected to the primary surface treating arrangement. In the preferred embodiment, an auxiliary surface treating arrangement is spaced inwardly of the output tube and is non-rotatably mounted on the driving mechanism. The auxiliary surface treating arrangement includes a manually actuated pump slidably mounted relative to the output tube for controllably delivering a supply of the surface treating material to the primary surface treating arrangement.

37 Claims, 8 Drawing Sheets

FIG. 1
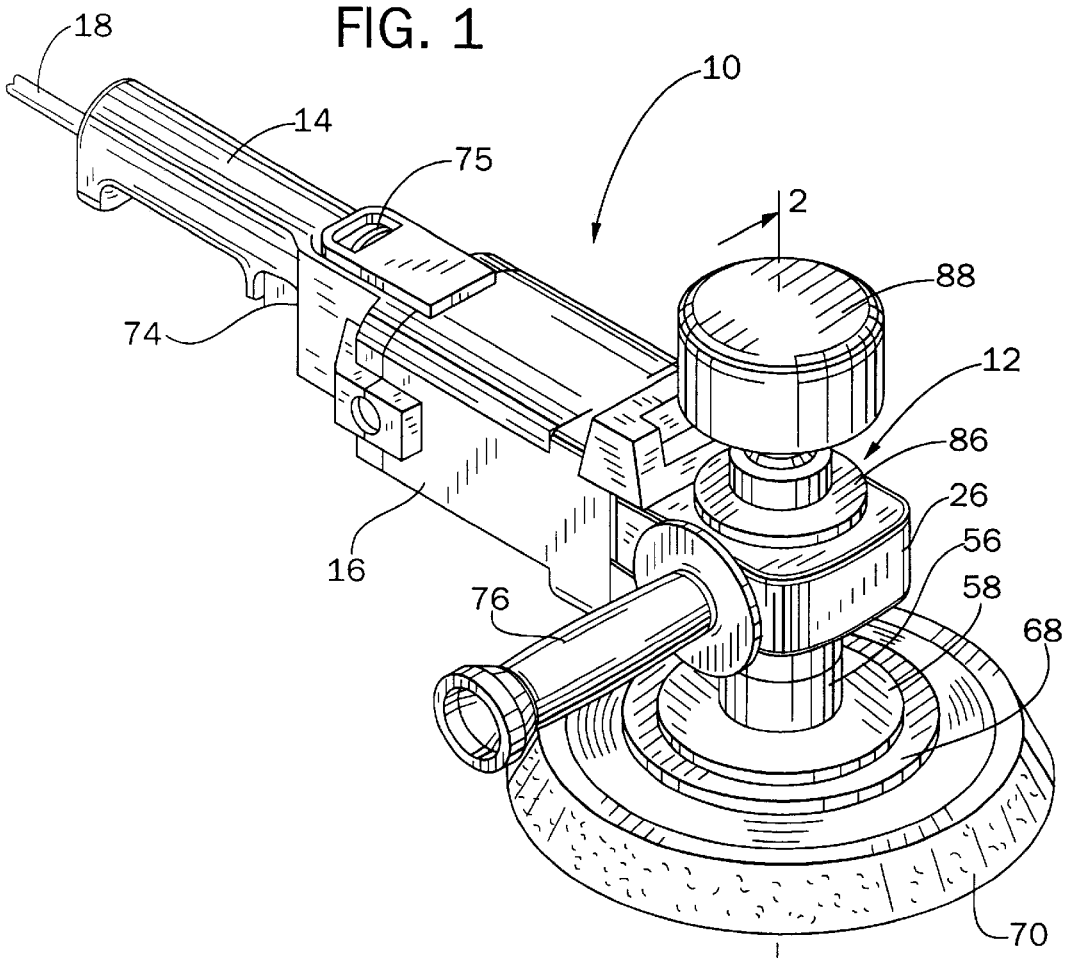
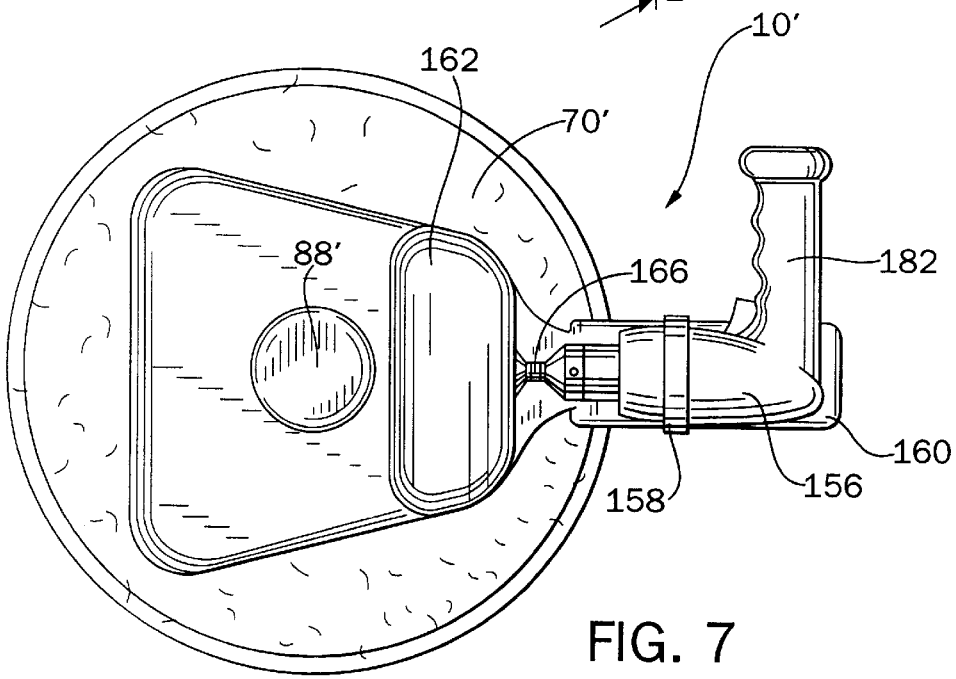
FIG. 7

FIG. 5
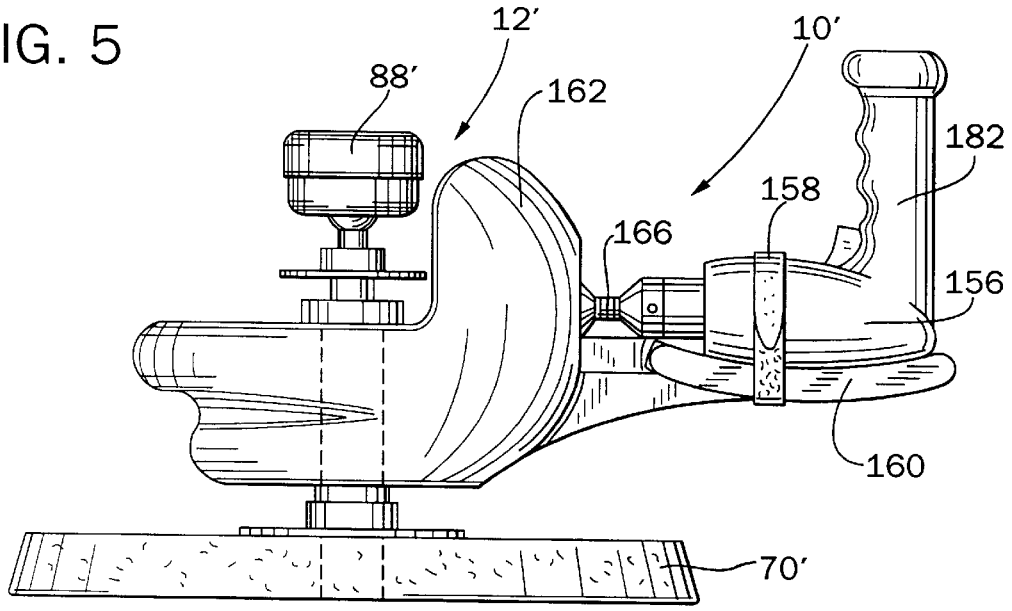
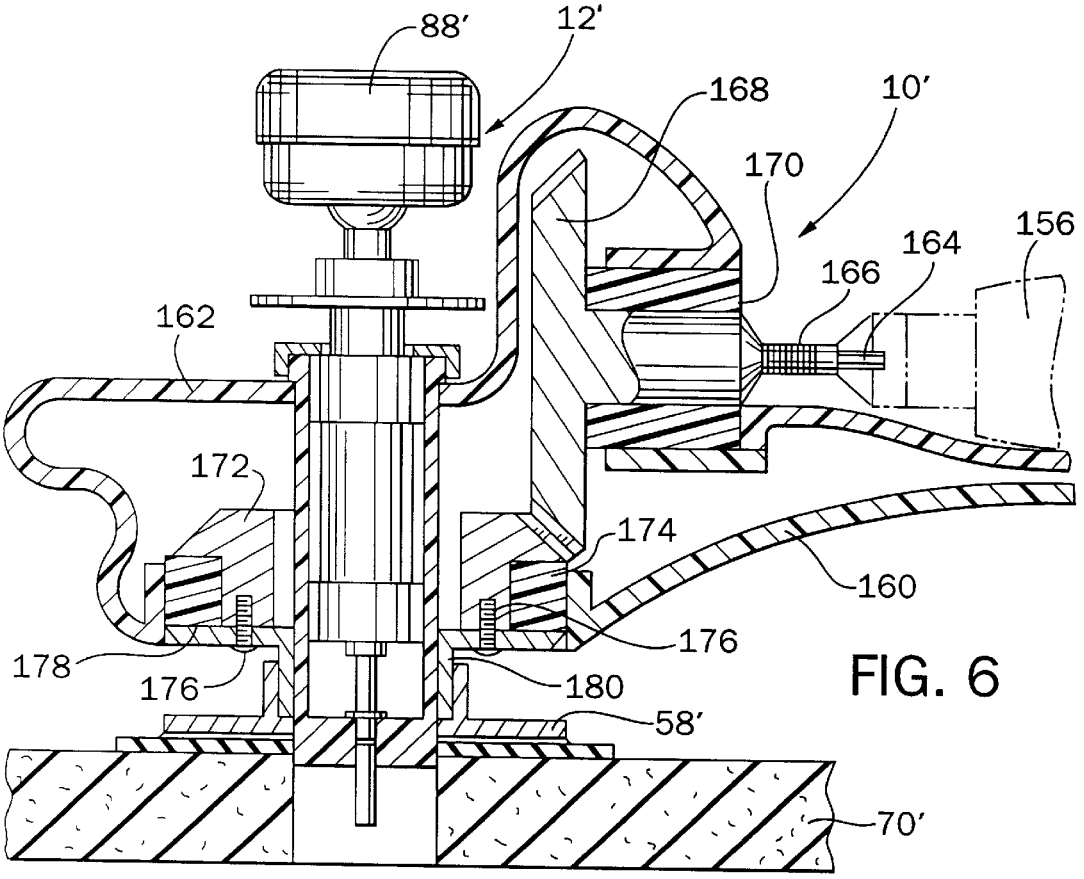
FIG. 6

AUXILIARY SURFACE TREATING ARRANGEMENT FOR SURFACE TREATING DEVICE

CROSS-REFERENCE TO RELATED APPLICATIONS

This application is a continuation-in-part of U.S. Application Ser. No. 08/942,099, filed Oct. 1, 1997, now abandoned.

FIELD OF THE INVENTION

This invention relates generally to a surface treating device having a rotatable or movable treating element and, more particularly, pertains to the incorporation of an auxiliary surface treating arrangement in the driving mechanism of the wet surface treating device.

BACKGROUND OF THE INVENTION

Various surface treating devices which include an electric motor driven mechanism having a rotatable or output shaft upon the end of which is mounted a rotatable or movable surface treating element, such as a cloth or foam pad, are currently in use. Such surface treating devices are widely used in a variety of polishing and buffing applications, such as in automobile body finishing and maintenance operations.

Typically, one using an electric polishing/buffing machine to apply a surface treating material, such as a liquid wax, paste, conditioner, or other solution, squirts an amount of the treating liquid directly onto the pad or the metal, fiberglass or other surface to be treated. Then, the machine is activated to rotate or otherwise move the pad and work the liquid into the surface at various speeds and under various loads as applied by the machine operator. When using this well known method, polishing or buffing must be interrupted each time surface treating liquid needs to be applied. In addition, an operator running the polishing/buffing machine at high speeds may inadvertently disperse the surface treating liquid away from the surface area being treated, or may simply apply inconsistent amounts of treating liquid which can effect the quality of the polishing/buffing operation.

One attempt to overcome these drawbacks is disclosed in U.S. Pat. No. 4,523,411 issued to Freerks on Jun. 18, 1985. In this patent, a conventional dry surface treating device is converted into a wet surface treating device used in a sanding operation to provide a generally centered liquid supply on the working face of the rotatable element. That is, the rotatable pad or disc is provided with a first basin-like recess having a generally transverse flat bottom and side walls defining a channel opening toward and extending around the rotational axis of the pad. An opposed second surface includes an opening within or adjacent to an area generally centered with respect to the axis. The rotatable element also includes at least one passage communicating between the channel and opening, so that liquid collected in the recess will flow into the channel through the passage and out through the opening when the pad or disc is stationary or rotated about the axis. Liquid is delivered to the recess via a tube offset from the rotatably driven shaft of the device. With this construction, it is difficult to predict the amount of liquid actually being supplied to the opening due to the centrifugal force applied to the pad. In addition, the flow of liquid is simply controlled by an on-off valve and is supplied from an external source which may be satisfactory for wetting large amounts of airborne particles developed in a sanding operation, but fails to provide the necessary dispensing control from a reservoir mounted directly on the surface treating device, as is desired in a buffing or polishing operation.

Accordingly, there remains a need for a surface treating device which will more effectively and controllably disperse an amount of surface treating liquid to a rotatable or movable surface treating element. Likewise, it is desirable to provide a surface treating device adapted to incorporate a dispensing arrangement which may be conveniently actuated during operation of the surface treating device. Also, it is desirable to provide a wet surface treating device having a dispensing arrangement which is compact and self-contained within the driving mechanism of the surface treating device. In addition, it is sometimes desirable to treat the working surface with another tool such as a grinder/sander or heat lamp.

SUMMARY OF THE INVENTION

It is a primary object of the present invention to provide an improved surface treating device for use with a driven motor.

It is also an object of the present invention to provide an auxiliary surface treating arrangement for selectively providing auxiliary surface treatment to the working surface.

It is a further object of the present invention to provide a surface treating device having a dispensing arrangement including a manually actuated pump.

It is an additional object of the present invention to provide a surface treating device having a dispensing arrangement with a reservoir which is tiltably mounted on the device, so as to improve the dispensing of the surface treating liquid stored in the reservoir.

It is yet another object of the present invention to provide a surface treating device which employs a commercially available buffer/polisher, or an electrically or battery powered drill in conjunction with an on-board pumping and dispensing arrangement.

Still another object of the present invention is to provide a surface treating device having a power accessory attachment for enabling power to be delivered to auxiliary equipment mounted on the surface treating device.

One aspect to the invention relates to a surface treating device having a driving mechanism for moving a primary surface treating arrangement having at least one through hole relative to a working surface. An improvement resides in an auxiliary surface treating arrangement non-rotatably mounted on and having opposite ends extending through the driving mechanism. At least one of the ends of the auxiliary surface treating arrangement extends into the one through hole in the primary surface treating arrangement for selectively providing auxiliary surface treatment relative to the working surface. In the preferred embodiment, the auxiliary surface treating arrangement is embodied in a dispensing arrangement. The dispensing arrangement has a cover and a reservoir for storing a supply of surface treating material therein. The dispensing arrangement is incorporated into the driving mechanism of the surface treating device for selectively pumping a quantity of surface treating material through the driving mechanism to the center of the primary surface treating arrangement. The reservoir is tiltably mounted relative to the driving mechanism, and the dispensing arrangement is non-rotatably mounted to the driving mechanism. In one form of the invention, the driving mechanism includes a motor in a polishing or sanding machine. In another form of the invention, the driving mechanism includes a motor in an electrically driven or battery powered drill. In its most basic form, the auxiliary surface treating arrangement includes a cylindrical sleeve. The sleeve accommodates a grinder/sander, a heat gun, or other tool. A power accessory attachment is provided for enabling delivery of power to auxiliary equipment mounted on the device.

In another aspect of the invention, a surface treating device is provided for rotating a primary surface treating arrangement supplied with a surface treating liquid relative to a working surface. The device includes a driving mechanism for rotating the primary surface treating arrangement including a driven output tube operably connected to the primary surface treating arrangement. An auxiliary surface treating arrangement, such as a dispensing arrangement, is spaced inwardly from the output tube and is non-rotatably mounted on the driving mechanism. The dispensing arrangement includes a manually actuated pump slidably mounted relative to the output tube for controllably delivering a supply of the surface treating liquid to the primary surface treating arrangement. The dispensing arrangement includes an outer tubular structure fixedly connected to the driving mechanism, and an inner tubular structure connected with the pump and slidably mounted relative to the outer tubular structure. A power accessory attachment is provided for enabling delivery of power to the auxiliary surface treating arrangement.

In another aspect of the invention, a surface treating device is provided for rotating a primary surface treating arrangement provided with a central hole relative to a working surface. The device includes a driving mechanism for rotating the primary surface treating arrangement, the driving mechanism including a motor support and a gearcase connected thereto. The motor support has a motor for driving a driven shaft terminating in a first gear. The gearcase is provided with a rotatable second gear engageable with the first gear, and a cylindrical output tube having an upper end interconnected with the second gear and a lower end operably connected to the primary surface treating arrangement. The output tube is rotated about an axis substantially perpendicular to the primary surface treating arrangement and is disposed above the central hole formed in the primary surface treating arrangement. A dispensing arrangement is mounted on the driving mechanism for controllably delivering a supply of surface treating liquid to the hole formed in the surface treating element. The dispensing arrangement includes a tubular pumping arrangement disposed internally of the output tube and non-rotatably secured to the gearcase, an actuating member fixed to the pumping arrangement and a reservoir movably mounted on the actuating member for holding a supply of surface treating liquid. The reservoir, the actuating member and the pumping arrangement are formed with a passageway for conveying surface treating liquid from the reservoir to the hole formed in the surface treating element. An upper bearing element is mounted in a top portion of the gearcase, and a lower bearing element is secured in a bottom portion of the gearcase. The inner diameter of the output tube is substantially equal to the diameter of the central hole formed in the surface treating element. A backing plate assembly includes a tubular collar removably attached to the lower end of the output tube, a backing plate extending generally perpendicular to the collar, a flexible backing pad attached to the surface treating element and a fastener structure for removably joining the backing plate to the backing pad. The backing plate, the backing pad, and the fastener structure are formed with a common bore equal to the inner diameter of the output tube and the diameter of the central hole formed in the surface treating element. The tubular pumping arrangement includes a cylindrical sleeve having an open upper end fixed to the gearcase, a side wall engageable with the upper bearing element and spaced inwardly from the output tube, and a bottom end supported within the central hole in the surface treating element and formed with a channel within which a delivery tube is provided. A cap is cooperable with the upper end of the cylindrical sleeve to fix the sleeve to the gearcase. The tubular pumping arrangement also includes an outer cylindrical tube slidably mounted in the cylindrical sleeve for movement between the cap and the bottom end of the cylindrical sleeve. An inner cylindrical tube is disposed within and mounted for sliding movement together with the outer cylindrical tube relative to the cylindrical sleeve. The inner cylindrical tube defines a casing for a pump operable to permit the metered flow of surface treating liquid from the reservoir to the delivery tube in the bottom end of the cylindrical sleeve and the central hole formed in the surface treating element. The inner cylindrical tube has an upper portion that extends upwardly through the cap and is removably secured to the actuating member. A lower portion of the inner cylindrical tube is seated in the outer cylindrical tube and is formed with a central opening generally aligned with the channel in the bottom end of the cylindrical sleeve. The pump includes a cylindrical cartridge having a restricted open, upper end and a radially enlarged lower end formed with a first set of openings therein. An elongated tubular stem extends through the central opening of the lower portion of the outer cylindrical tube, the stem having a stub end projecting into the channel formed in the bottom end of the cylindrical sleeve. A stop member is engageable against the bottom end of the cylindrical sleeve. A seat member is normally engageable with the enlarged lower end to block communication of the first set of openings. A second set of openings is provided in the stem beneath the seat member. A ball is lodged in the restricted upper end and a spring is interposed between the seat member and the ball for normally spacing the actuating member from the cap and biasing the seat member against the lower portion of the inner cylindrical tube and the stop member against the bottom end of the cylindrical sleeve. With this construction, liquid introduced from the reservoir through the passageway to the interior of the inner cylindrical tube will normally be prevented from exiting therefrom due to the engagement of the seat member against the lower portion of the inner cylindrical tube. Moving the actuating member against the bias of the spring into engagement with the cap will cause sliding of the inner and outer cylindrical tubes relative to the cylindrical sleeve, as well as sliding of the cartridge along the stem, such that liquid will flow through the first set of openings into the second set of openings and through the stem and delivery tube to the central hole formed in the surface treating arrangement. In one form of the invention, the first gear is a pinion and the second gear is a ring gear. The upper bearing element is engageable with the upper end of the output tube, and the lower bearing element is engageable with a mid-portion of the output tube. The side wall of the cylindrical sleeve is engageable with the upper biasing element. In another form of the invention, the motor is embodied in an electric drill. The reservoir is tiltably mounted about a ball joint extending upwardly from the actuating member. A power accessory attachment and auxiliary power equipment is mounted on the surface treating device so that the power accessory attachment enables power to be delivered to the auxiliary power equipment.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is a perspective view of a surface treating device embodying the auxiliary surface treating arrangement of the present invention;

FIG. 5 is a front view of a first alternative embodiment of the present invention employing an electrically or battery powered drill with a vertically disposed handle;

FIG. 6 is an enlarged, sectional view of the surface treating device shown in FIG. 5;

FIG. 7 is a top view of the surface treating device of FIG. 5 showing the drill having a horizontally disposed handle;

DETAILED DESCRIPTION OF THE INVENTION

Figure 2:
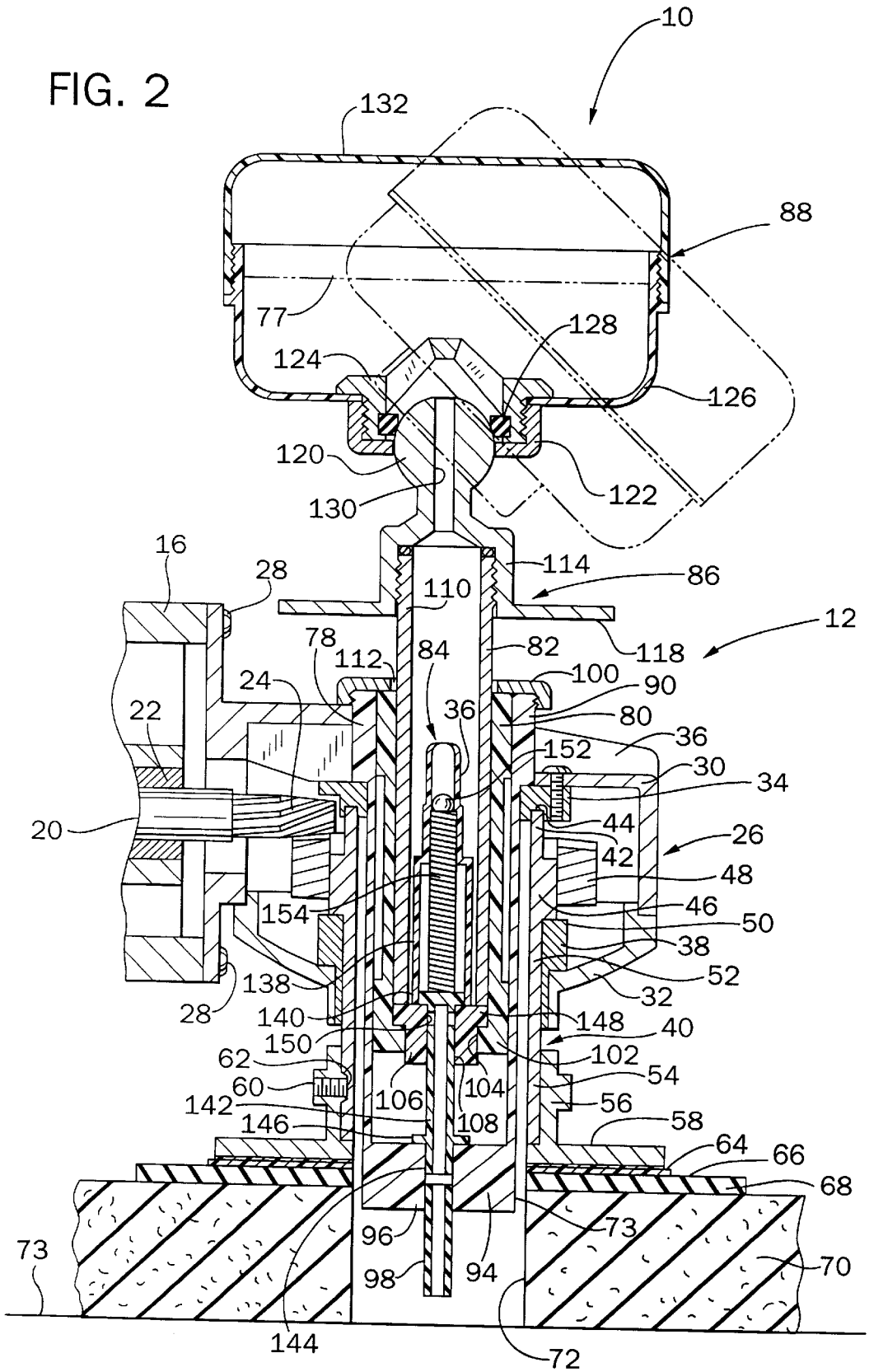
FIG. 2 is a partial sectional view taken along line 2—2 of FIG. 1 showing the storage of a surface treating liquid in a reservoir mounted on the surface treating device and a pump used to deliver the surface treating liquid to a surface treating pad.

Referring now to the drawings, FIG. 1 illustrates a perspective view of an electrically driven, commercially available wet surface treating machine 10 incorporating an auxiliary surface treating arrangement 12 of the present invention. In the preferred embodiment shown in FIGS. 1–4, the wet surface treating device 10 is embodied in the form of a buffing or polishing device having a primary handle 14 extending rearwardly from a motor housing or support 16 which encloses and mounts a motor (not shown) therein. Electrical power is typically supplied to energize the motor through a heavy duty cord 18 which extends through the handle 14 and is connected to a suitable source.

As seen in FIG. 2, the motor has a rotatable output shaft 20 supported in a set of bearings 22 and terminating in a pinion 24. A gearcase 26 is attached, such as by screws 28, to the end of motor housing 16 and includes a top portion 30 removably secured such as by fasteners (not shown) to a bottom portion 32. An upper brass bushing 34 is secured to the top portion 30 of gearcase 26 by a screw 36, and a lower brass bushing 38 is pressed into the bottom portion 32 of gearcase 26 to rotatably support a cylindrical output tube 40. Brass bushings 34,38 may be replaced by any suitable bearing element.

The output tube 40 has an uppermost portion 42 which rides in an annular groove 44 formed in the upper brass bushing 34, and is followed with a radially enlarged neck 46 upon which a rotatable ring gear 48 is supported. Neck 46 has a shoulder 50 which rests upon the upper end of the lower brass bushing 38. A mid portion 52 of the output tube 40 is borne against the inner wall of the lower brass bushing 38, and a lowermost portion 54 provides a mounting surface for the cylindrical hub 56 of a circular backing plate 58.

The hub 56 accommodates a set screw 60 which is engageable with a depression 62 formed in the lowermost portion 54 of the output tube 40 to secure the backing plate 58 in position. The base of the backing plate 58 is provided with a conventional hook-and-loop fastener 64 which is cooperable with a mating hook-and-loop fastener 66 disposed on the top of a circular flexible backing pad 68. A rotatable primary surface treating arrangement 70 is fixed or demountably attached by any suitable bonding agent to the underside of the backing pad 68. As will be appreciated hereinafter, the surface treating arrangement 70 is formed with a central hole 72 which is equal to the inner diameter of the output tube 40 disposed above the hole 72. In the embodiment shown in all of the Figures, the primary surface treating arrangement 70 preferably is a circular foam buffing and polishing pad made of various synthetic foam materials. However, as is well known, the pad 70 may also be constructed of tufted natural wool or synthetic fibers. While the embodiments described herein employ a soft pad for polishing and buffing, it should be understood that the invention may work equally well with an abrasive disc when it is desired to restrict airborne particulate matter created such as in a sanding operation.

Together, the backing plate 58, the hook-and-loop fasteners 64,66, the backing pad 68 and the buffing pad 70 form a backing plate assembly which is rotatably driven by driving the pinion 24 engaged with the ring gear 48 which is operably connected to the output tube 40. In a manner similar to the central hole 72 formed in pad 70, the backing plate 58, backing pad 68 and fasteners 64,66 are provided with a common bore 73 equal to the inner diameter of the output tube 40. The motor housing 16, motor output shaft 20, pinion 24, ring gear 48 and output tube 40 define a driving mechanism for rotating or otherwise moving the foam pad 70 against a working surface 73 (FIG. 2) and about an axis of rotation which is substantially perpendicular to the foam pad 70.

Referring back to FIG. 1, the machine 10 is provided with a variable speed trigger switch 74 on the primary handle 14, and an adjustable speed control wheel 75 on the top of the motor housing 16 in order to vary the rotational speed of the buffing pad 70. The machine 10 is further equipped with an auxiliary handle 76 which is screwed into a suitably threaded opening on the right side of the gear case 26, and alternatively may be screwed into a similarly threaded hole on the left side of the gear case, as desired by the operator.

In accordance with the invention, there is provided an auxiliary surface treating arrangement 12 for selectively providing auxiliary treatment of the working surface 73. In the preferred embodiment, the auxiliary surface treating arrangement 12 is defined by a dispensing arrangement which is incorporated into the driving mechanism of the surface treating device 10 for controllably delivering and selectively pumping a quantity of surface treating material 77, preferably in a liquid state, through the driving mechanism to the center of the primary surface rotating arrangement 70. More particularly, the auxiliary surface treating arrangement 12 embodied by the dispensing arrangement is spaced inwardly of the outlet tube 40 and is non-rotatably mounted on the driving mechanism.

With further reference to FIG. 2, the dispensing arrangement is chiefly comprised of a cylindrical sleeve 78, an outer cylindrical tube 80, an inner cylindrical tube 82, a manually actuated pump 84, an actuating member 86, and a reservoir 88.

Figure 9:
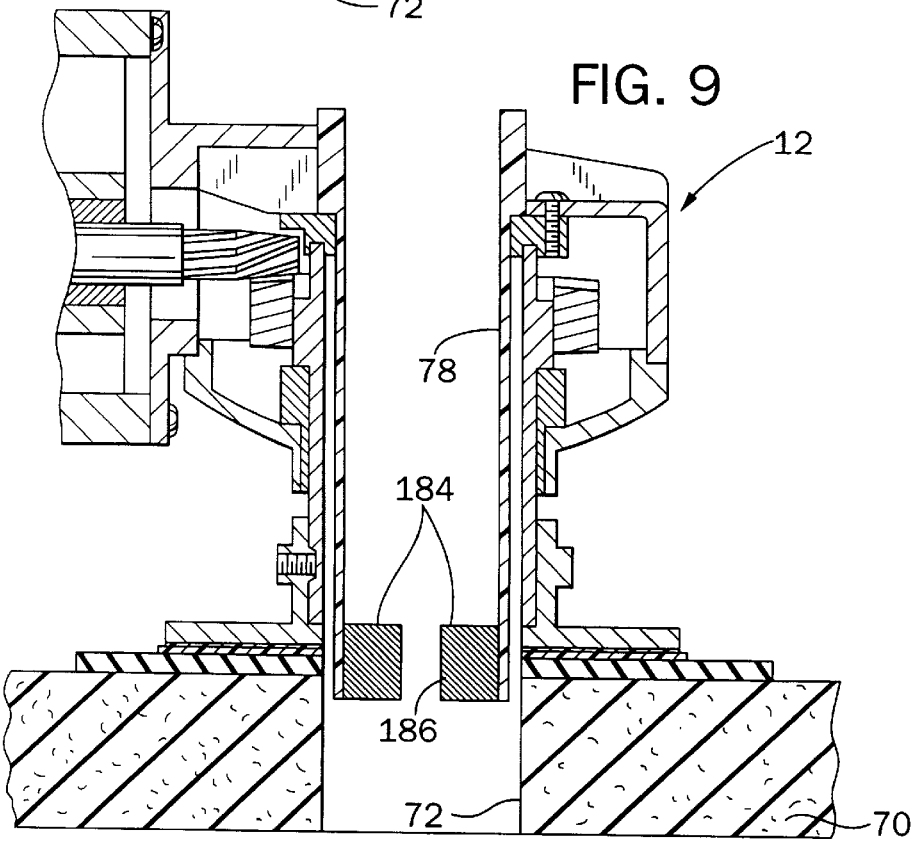

Cylindrical sleeve 78 has an open upper end 90 and a side wall 92 engageable with the upper brass bushing 34 and spaced inwardly from the open tube 40. The sleeve 78 also has a thickened bottom end 94 supported within the central hole 72 in the foam pad 70 and formed with a channel 96 within which a downwardly depending delivery tube 98 is provided. Alternately, the bottom end 94 could be replaced by a separate component, such as an apertured nylon bushing 184, such as shown in FIG. 9. The open upper end 90 is threaded so as to be received in a suitably threaded cap 100 which removably fixes the sleeve 78 to the top portion 30 of the gearcase 26 and allows the sleeve 78 to be suspended internally of the outlet shaft 40. Outer cylindrical tube 80 is shorter in length than the cylindrical sleeve 78 and is slidably mounted in the cylindrical sleeve 78 for movement between the cap 100 and the bottom end 94 of the cylindrical sleeve 78. Outer cylindrical tube 80 has a lower portion 102 (FIGS. 2,4) which is formed with a central opening 104.

Inner cylindrical tube 82 is disposed within and mounted for sliding movement together with the outer cylindrical tube 80 relative to the cylindrical sleeve 78. Inner cylindrical tubing 82 has a lower plug portion 106 seated in the lower portion 102 of outer cylindrical tube 80, and formed with a central port 108 (FIG. 2) generally aligned with the channel 96 in the bottom end of the cylindrical sleeve 78. Inner cylindrical tube 82 also has an upper portion 110 that extends upwardly through an aperture 112 formed in cap 100, and is threaded to be received in a threaded crown portion 114 of a hat-shaped trigger 86 which forms the actuating member. The trigger 86 also has a circular flat rim portion 118 which is adapted to be pushed down manually against the biasing force applied by the pump 84. The actuating member 86 is integrally formed with a ball joint 120 which is tiltably supported by a retainer ring 122 threaded onto a sieve-like drain nut 124 carried by a bottom 126 of the reservoir 88. A sealing ring 128 is positioned between the drain nut 124 and the ball joint 120 to prevent leakage of fluid through the retaining ring 122 and around the ball joint 120. A passageway 130 formed in the ball joint 120 facilitates continuous communication between the interior of the reservoir 88 and the interior of the inner cylindrical tube 82. The reservoir 88 serves to store a quantity of surface treating material 77, preferably in a liquid form of a paste, wax, conditioner, or other solution. A cover top 132 is screw-threadedly attached to the bottom 126 of the reservoir 88. The tiltable or swivel mounting of the reservoir 88, depicted in phantom lines in FIG. 2, is particularly useful when operating the surface treating device 10 against a non-horizontal working surface such as the side of an automobile or boat. The tilting reservoir 88 will ensure maximum flow of the surface treating liquid 77 from the reservoir 88 into the inner cylindrical tube 82.

Pump 84 includes a cylindrical cartridge 134 having a restricted open upper end 136 and a radially enlarged lower end 138 formed with a first set of openings 140 therein. Pump 84 also has an elongated tubular stem 142 extending through the central opening 104 in the lower portion 102 of the outer cylindrical tube 80. The stem 142 has a stub end 144 projecting into the channel 96 formed in the bottom end of the cylindrical sleeve 78, and a stop member 146 engageable against the bottom end 94 of the cylindrical sleeve 78. The stem 142 further includes a seat member 148 normally engageable with the lower plug portion 106 to block communication of the first set of openings 140, and a second set of openings 150 provided beneath the seat 148. A ball 152 is lodged in the restricted upper end 156 and a coil spring 154 is interposed between the seat member 148 and the ball 152 for normally spacing the actuating member 116 from the cap 100 and biasing the seat member 148 against the lower plug portion 106 of the inner cylindrical tube 82, and the stop member 146 against the bottom end 94 of the cylindrical sleeve 78, as shown in FIG. 2. As will be detailed below, the pump 84 is operable to permit the metered flow of liquid 77 from the reservoir 88 to the delivery tube 98 and the central hole 72 formed in the buffing pad 70.

Figure 3:
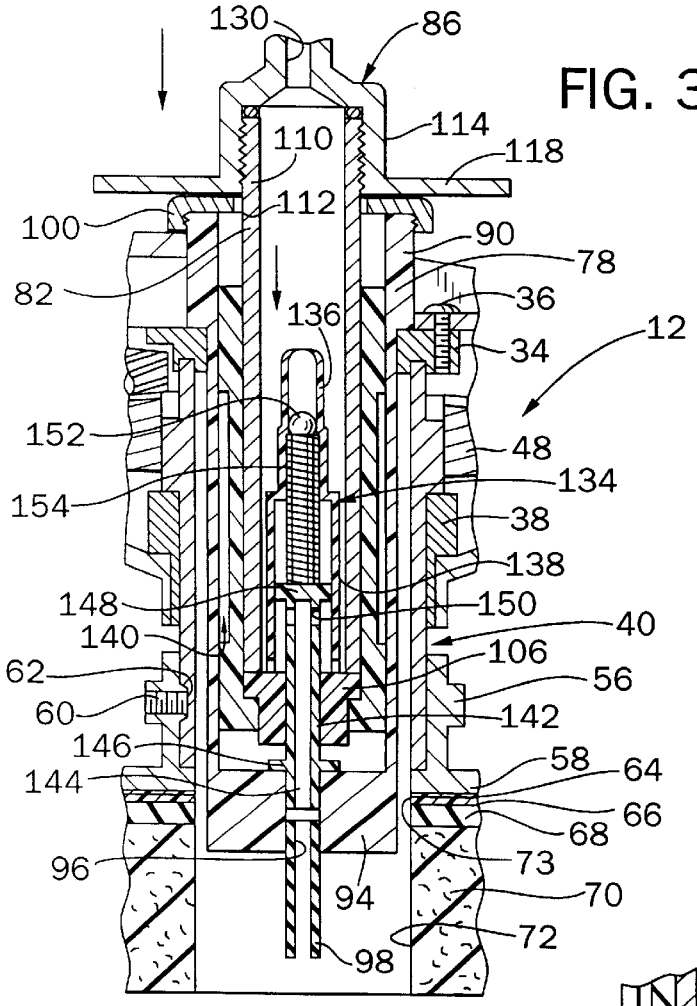
FIG. 3 is a fragmentary sectional view similar to FIG. 2 showing the metering of the surface treating liquid in the reservoir to the surface treating pad.
Figure 4:
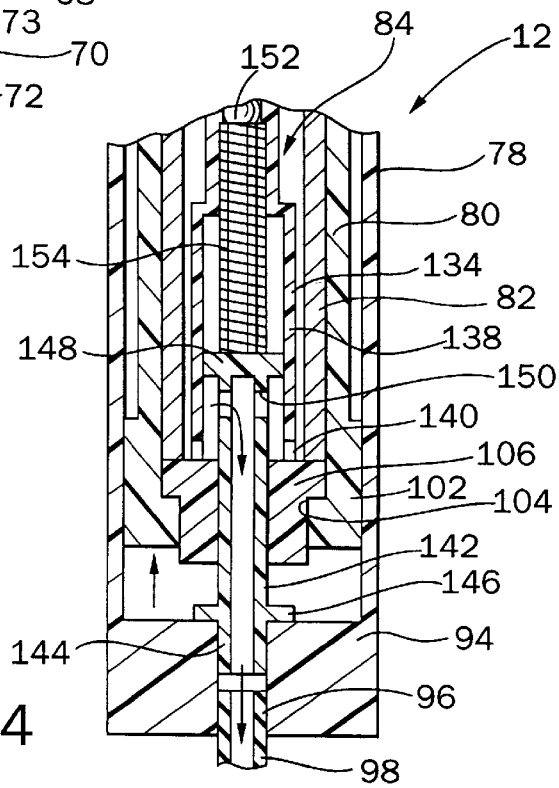
FIG. 4 is an enlarged, fragmentary sectional view similar to FIG. 3 focusing on a lower portion of the dispensing arrangement.

With the dispensing arrangement 12 set forth above, surface treating liquid 77 in the reservoir 88 will flow through the passageway 130 into the interior and the lower portion of the inner cylindrical tube 82 in the annular space between the interior of the inner cylindrical tube 82 and the exterior of the radially enlarged lower end 138 of pump cartridge 134. Liquid 77 is prevented from flowing through the first set of openings 140 by the engagement of seat member 148 urged against the lower plug portion 106 of the inner cylindrical tube 82 by spring 154. Referring to FIG. 3, when it is desired to controllably dispense an amount of liquid 77 from the reservoir 88 to the polishing pad 70, the actuating member 86 is pushed against the biasing spring 154, such as by using the thumb of the operator's hand positioned on the auxiliary handle 76, until the actuating member 86 contact the cap 100. When this occurs, the inner and outer cylindrical tubes 80,82 slide in unison relative to the cylindrical sleeve 78. In addition, the pump cartridge 134 slides along the stem 142 such that the spring 154 is compressed and the first set of openings 140 becomes displaced from the seat member 148. As a result, liquid 77 will first flow through the first set of openings 140, as shown by the arrow in FIG. 3, and then will flow through the second set of openings 150, as shown by the arrow in FIG. 4. The liquid 77 then passes through the interior of stem 142 and flows through the delivery tube 98 and into the central hole 72 formed in the buffing pad 70 from which the liquid 77 is radially dispersed along the underside thereof to the work surface.

As seen in FIG. 3, the dispensing arrangement 12 is suitably dimensioned such that the lower plug portion 106 of the inner cylindrical tube 82 approaches the stop member 146 as the actuating member 86 contacts the cap 100. Once the actuating member 86 is released, the compressed spring 154 forces the inner and outer cylindrical tubes 80,82 in the opposite direction along with the cartridge 134 which slides on the stem 142 until the seat member 148 again engages the lower plug portion 106 and blocks flow of liquid to the first set of openings 140.

FIGS. 5–7 illustrate a first alternative embodiment which has an identical dispensing arrangement 12 as above described and will be explained using like reference numerals where possible to facilitate clarity. Surface treating device 10' differs from the preferred embodiment of FIGS. 1–4 in the type of driving mechanism used to rotate the primary surface treating arrangement 70'. In this version, a commercially available electrically or battery powered drill 156 functions as the motor and is mounted such as by a retaining strap 158 to a support 160 which, in turn, is connected to a gear case 162. The output shaft 164 of the drill 156 is attached to a flexible coupling 166 to transfer rotation to a first gear 168 supported by an upper bearing 170 and placed in meshing engagement with a second gear 172 supported by a lower bearing 174. The second gear 172 is joined by screws 176 to the flanges 178 of an output tube 180 to which a backing plate assembly is mounted. FIGS. 5 and 6 show the drill 156 mounted in a position with its handle 182 disposed vertically. FIG. 7 shows a surface treating device 10' exactly like FIGS. 5 and 6 except for the drill handle 182 being mounted in a horizontal orientation.

It should now be appreciated that the present invention provides a wet surface treating device having a dispensing arrangement 12 or 12' which is non-rotatably mounted relative to the driving mechanism. This feature helps avoid the centrifugal forces present in prior art designs residing in the rotatable buffing pad. Also, the tiltable reservoir mounting in the present invention provides for maximum dispensing of the surface treating liquid regardless of the orientation of the surface treating device. Further, the dispensing arrangement of the present assembly permits a metered dose of surface treating liquid to be delivered directly to the center of the surface treating pad so as to provide a more uniform dispersion of liquid onto the working surface.

Figure 8:
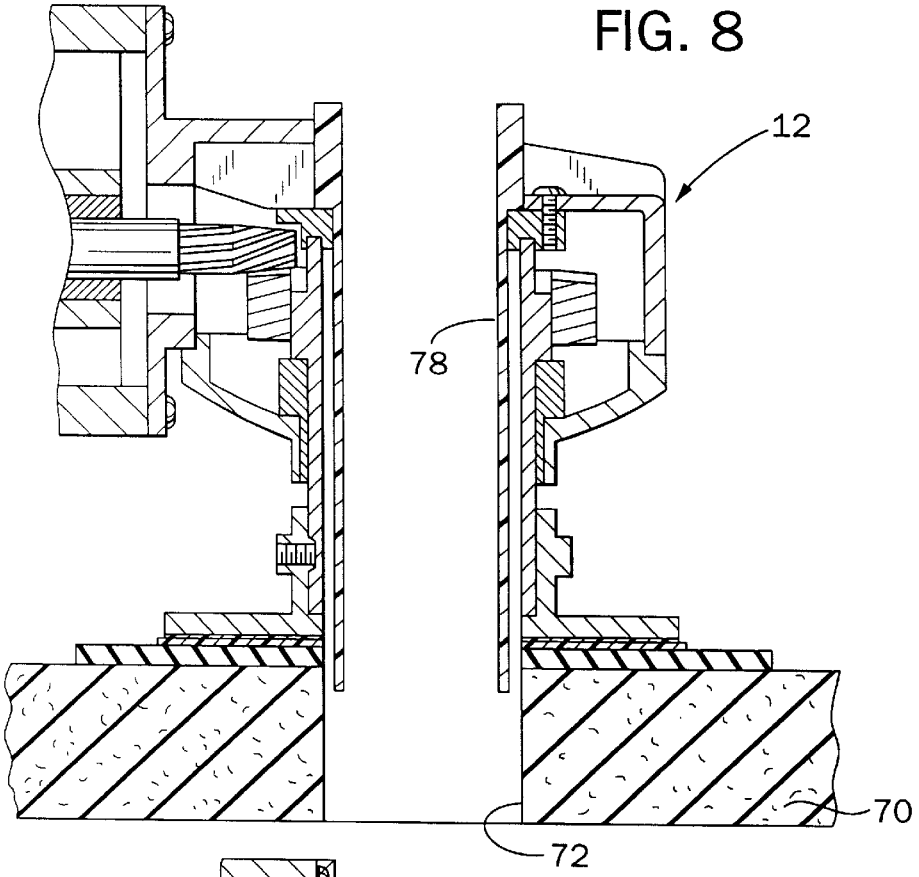
FIGS. 8 and 9 are views similar to FIG. 2 depicting basic embodiments of the present invention embodying auxiliary surface treating arrangements.

FIGS. 8 and 9 illustrate basic embodiments of the auxiliary surface treating arrangement 12. FIG. 8 shows the cylindrical sleeve 78 having a substantially constant diameter open at its top and bottom ends. FIG. 9 is similar to FIG. 8 but includes in its lower end a nylon bushing 184 having a central hole 186 formed therein.

Figure 10:
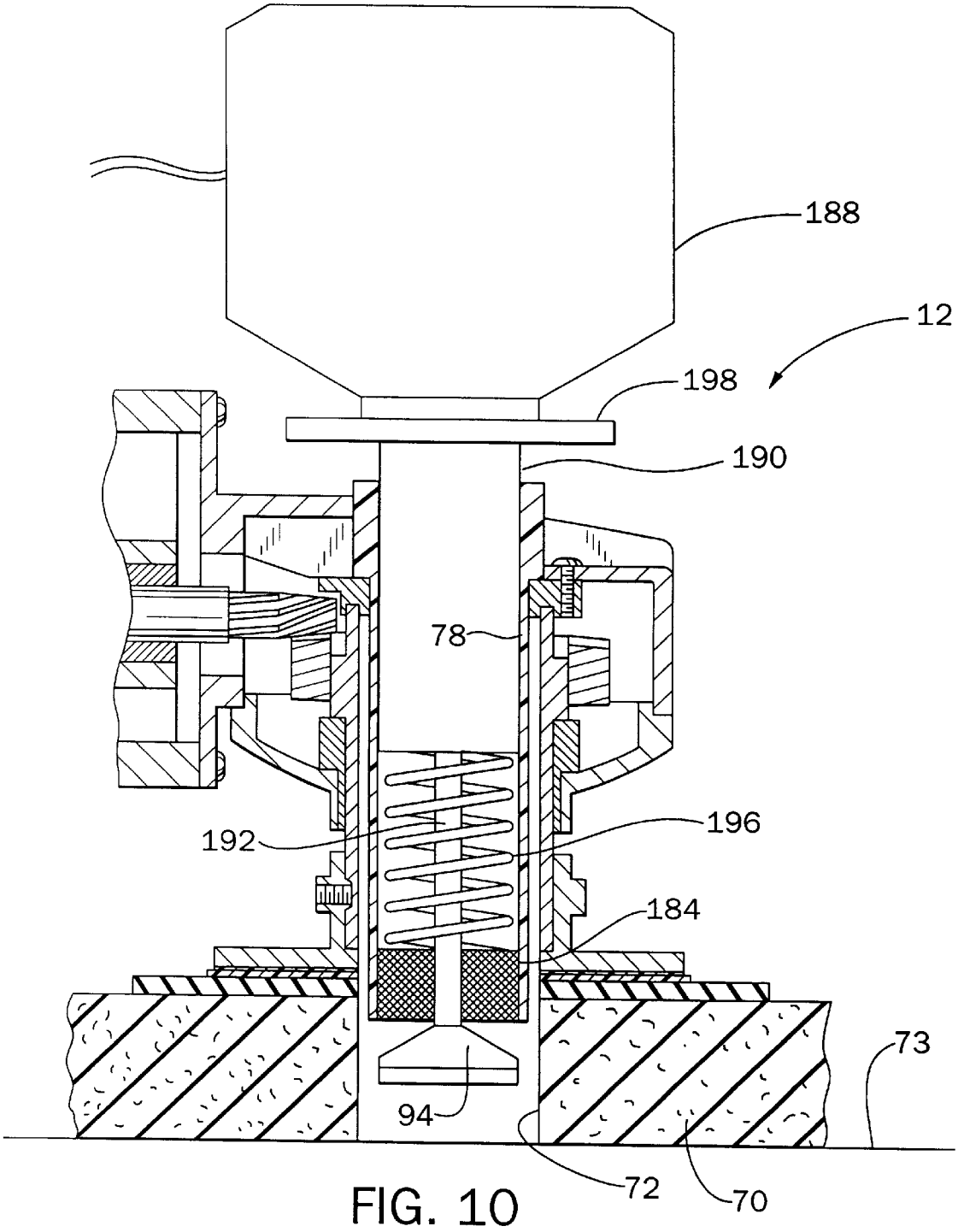
FIG. 10 is a view similar to FIG. 2 depicting a second alternative embodiment of the present invention employing a spring-biased grinder/sander.

FIG. 10 illustrates a second alternative embodiment of the invention in which a separately powered, grinder/sander 188 is incorporated into the driving mechanism of the surface treating device. In this version, the grinder/sander 188 includes a neck portion 190 positioned in the upper half of the sleeve 78 and a downwardly depending rotating shaft 192 which passes through aperture 96 and terminates in a grinding/sanding tool 194 which sits in the hole 71 and in pad 70. A coil spring 196 is disposed between the bottom of the neck portion 190 and the bushing 184, so that pushing down on a radially extending collar 198 at the top of the neck portion 190 will selectively move the tool 194 into engagement with the working surface 73 so as to provide an auxiliary treatment thereof. Release of the collar 198 will allow the spring 196 to return the tool 194 upwardly to the position shown in FIG. 10.

Figure 11:
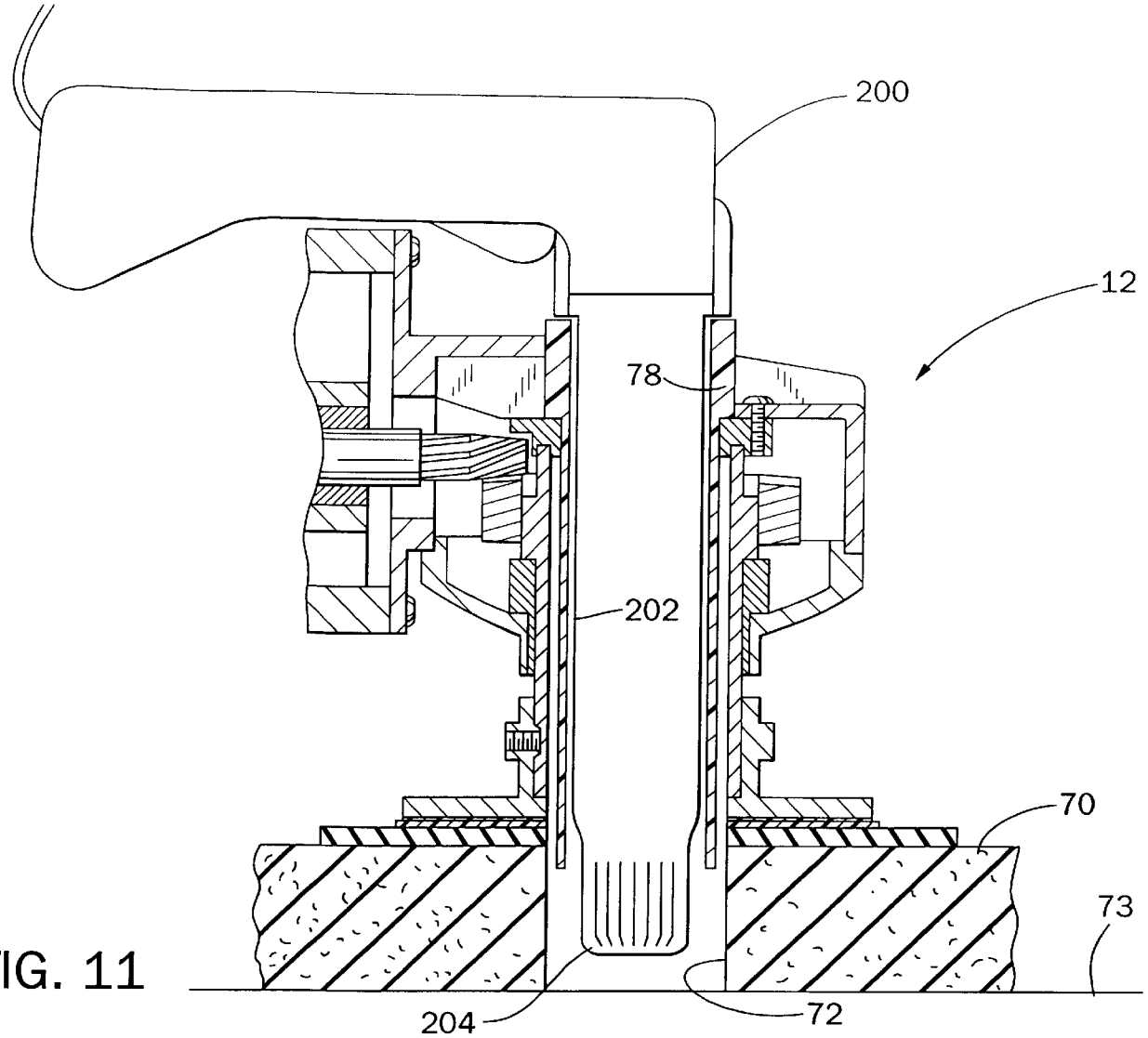
FIG. 11 is a view similar to FIG. 2 depicting a third alternative embodiment of the present invention employing a heat gun.

FIG. 11 illustrates a third alternative embodiment of the invention in which a separately powered heat gun 200 is incorporated into the driving mechanism of the surface treating device. In this version, the heat gun 200 has a long body 202 which extends downwardly through the sleeve 78 and is retainably disposed therein. The lower end of the heat gun 200 includes a heating element 204 used to selectively heat the working surface 73.

It should be further appreciated that the present invention provides an auxiliary surface treating arrangement 12 which complements the primary surface treating arrangement 70. The auxiliary surface treating arrangement 12 contemplates a dispensing arrangement as well as a processing tool such as a grinder/sander 188, heat gun 200 or any other tool which is non-rotatably mounted on the driving mechanism and accommodated in the bore of non-rotatable cylindrical sleeve 78.

Figure 12:
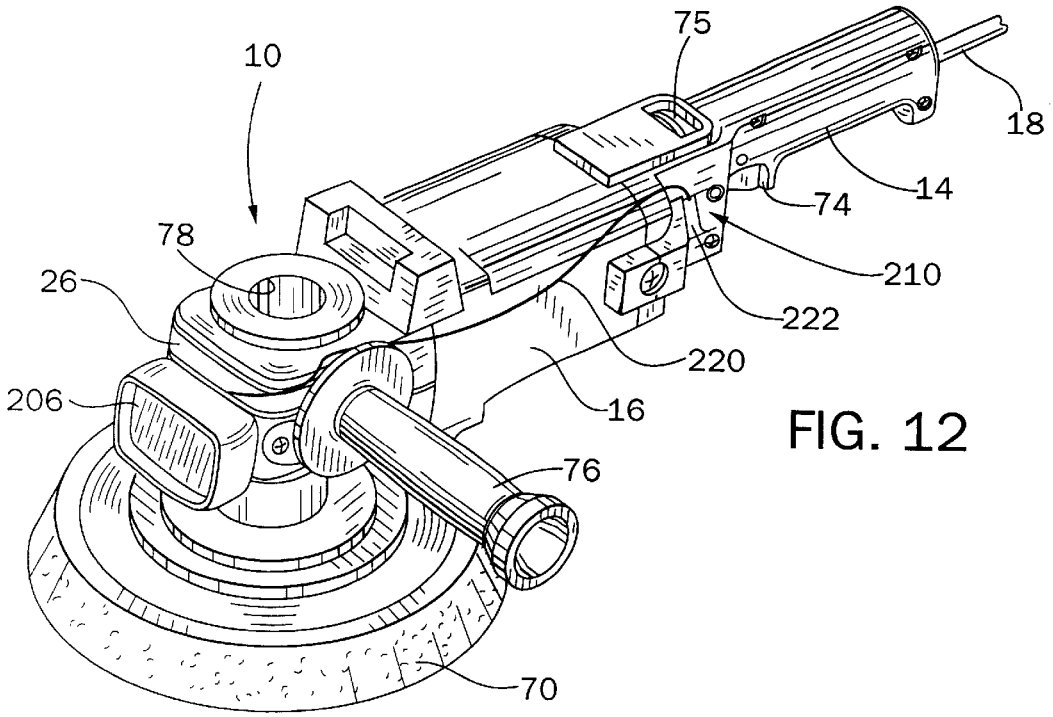
FIG. 12 is a perspective view of a surface treating device depicting a fourth alternative embodiment of the present invention employing an incandescent lamp and a power accessory attachment.
Figure 13:
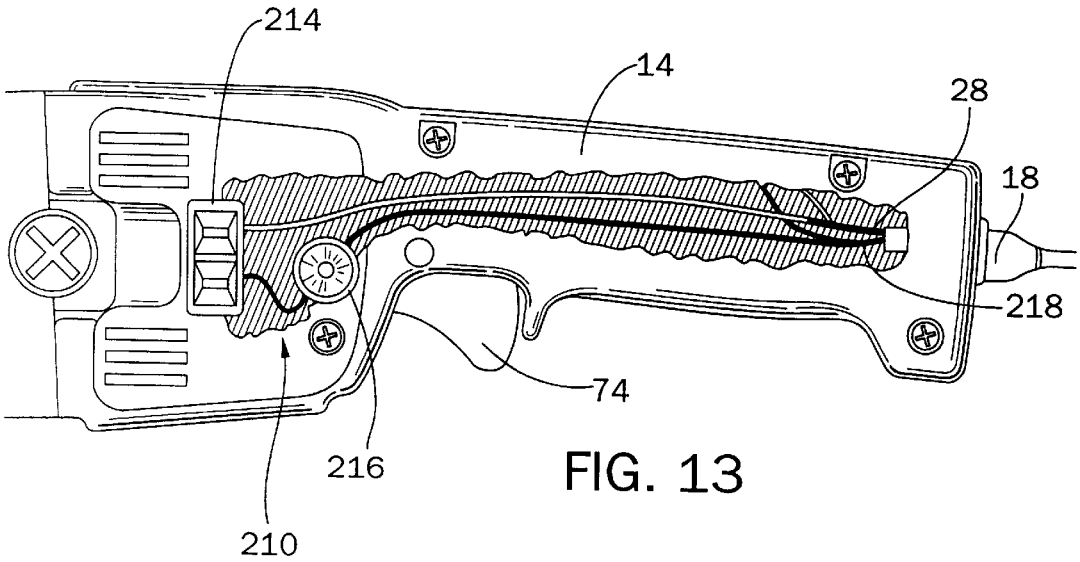
FIG. 13 is a fragmentary, enlarged perspective view of the handle portion of FIG. 12.

FIGS. 12 and 13 illustrate a fourth alternative embodiment of the invention which embodies the sleeve 78 shown in FIG. 8, and further includes an incandescent lamp 206 fixed against the gearcase 26, and a power accessory attachment 210 preferably secured to a side of handle 14. The power accessory attachment 210 is defined by an electrical receptacle 214 and a rotary switch 216 for selectively energizing and de-energizing electrical power delivered to the receptacle 214 and machine 10 through cord 18 and appropriate internal wiring connections 218. Lamp 206 has an electrical connection 220 terminating in a plug 222 which is selectively received in the receptacle 214 when it is desired to illuminate the working area with the lamp 206. It should be understood that other auxiliary power equipment besides lamp 206 can be mounted on the machine 10. Likewise, it should be understood that if desired another electrical receptacle may be provided on the machine 10. Such receptacle can be utilized to supply electrical power to an auxiliary tool like grinder/sander 188 or heat gun 200 when the receptacle is in communication with incoming electrical power delivered through cord 18.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth in the following claims.

I claim:

1. In a surface treating device having a driving mechanism for moving a primary surface treating arrangement having at least one through hole relative to a working surface, the improvement residing in:

an auxiliary surface treating arrangement including a cylindrical sleeve non-rotatably mounted on and having opposite ends extending through the driving mechanism, at least one of the ends of the cylindrical sleeve extending into the one through hole in the primary surface treating arrangement for selectively providing auxiliary surface treatment relative to the working surface.

2. The improvement of claim 1, wherein the auxiliary surface treating arrangement is defined by a dispensing arrangement.

3. The improvement of claim 2, wherein the dispensing arrangement includes a reservoir for storing a supply of surface treating material therein, the dispensing arrangement being incorporated into the driving mechanism of the surface treating device for selectively pumping a quantity of surface treating material through the driving mechanism to the through hole of the primary surface treating arrangement.

4. The improvement of claim 3, wherein the reservoir is provided with a removable cover.

5. The improvement of claim 1, wherein the reservoir is tiltably mounted relative to the driving mechanism.

6. The improvement of claim 1, wherein the driving mechanism includes a motor in a polishing or sanding machine.

7. The improvement of claim 1, wherein the driving mechanism includes a motor in an electrically driven or battery powered drill.

8. The improvement of claim 1, wherein the auxiliary surface treating arrangement includes a grinder/sander.

9. The improvement of claim 1, wherein the auxiliary surface treating arrangement includes a heat gun.

10. The improvement of claim 1, including auxiliary equipment and a power accessory attachment mounted on the surface treating device for enabling power to be delivered to the auxiliary equipment.

11. A surface treating device for moving a primary surface treating arrangement having at least one through hole relative to a working surface so as to effect a primary surface treatment thereof, the device comprising:

a driving mechanism for moving the primary surface treating arrangement including a driven output tube operably connected to the primary surface treating arrangement; and an auxiliary surface treating arrangement including a cylindrical sleeve spaced inwardly of the output tube and non-rotatably mounted on the driving mechanism, the cylindrical sleeve having a lower end protruding into the through hole of the primary surface treating arrangement for selectively providing auxiliary surface treatment relative to the working surface.

12. The surface treating device of claim 11, wherein the auxiliary surface treating arrangement is a dispensing arrangement.

13. The surface treating device of claim 12, wherein the dispensing arrangement includes a manually actuated pump slidably mounted relative to the output tube for controllably delivering a supply of surface treating liquid to the primary surface treating arrangement.

14. The surface treating device of claim 11, wherein the auxiliary surface treating arrangement includes a spring-biased, grinder-sander retained within the cylindrical sleeve.

15. The surface treating device of claim 11, wherein the auxiliary surface treating arrangement includes a heat gun retained within the cylindrical sleeve.

16. The surface treating device of claim 11, wherein the dispensing arrangement includes an outer tubular structure fixedly connected to the driving mechanism, and an inner tubular structure connected with the pump and slidably mounted relative to the outer tubular structure.

17. The surface treating device of claim 11, including a power accessory attachment for enabling power to be delivered to the auxiliary surface treating arrangement.

18. A surface treating device for rotating a primary surface treating arrangement provided with a central hole relative to a working surface, the device comprising:

a driving mechanism for rotating the surface treating arrangement, the driving mechanism including a motor support and a gear case connected thereto, the motor support having a motor for driving a driven shaft terminating in a first gear, the gear case being provided with a rotatable second gear engageable with the first gear and a cylindrical output tube having an upper end interconnected with the second gear and a lower end operably connected to the surface treating arrangement, the output tube rotating about an axis substantially perpendicular to the surface treating arrangement and disposed above the central hole formed in the surface treating arrangement; and a dispensing arrangement mounted on the driving mechanism for controllably delivering a supply of surface treating liquid to the hole formed in the surface treating arrangement, the dispensing arrangement including a tubular pumping arrangement disposed internally of the output tube and non-rotatably secured to the gear case, an actuating member fixed to the pumping arrangement and a reservoir movably mounted on the actuating member for holding a supply of surface treating liquid, the reservoir, the actuating member, and the pumping arrangement having a passageway for conveying surface treating liquid from the reservoir to the hole formed in the surface treating arrangement, wherein the tubular pumping arrangement includes a cylindrical sleeve having an open upper end fixed to the gear case, a side wall engageable with the upper bearing element and spaced inwardly from the output tube, and a bottom end supported within the central hole in the surface treating arrangement and formed with a channel within which a delivery tube is provided.

19. The surface treating device of claim 18, including an upper bearing element mounted in a top portion of the gear case, and a lower bearing element secured in a bottom portion of the gear case.

20. The surface treating device of claim 19, wherein the upper bearing element is engageable with the upper end of the output tube, and the lower bearing element is engageable with the mid-portion of the output tube.

21. The surface treating device of claim 18, wherein the inner diameter of the output tube is substantially equal to the diameter of the central hole formed in the surface treating arrangement.

22. The surface treating device of claim 18, including a backing plate assembly having a tubular collar removably attached to the lower end of the output tube, a backing plate extending generally perpendicularly to the collar, a flexible backing pad attached to the surface treating arrangement and a fastener structure for removably joining the backing plate to the backing pad.

23. The surface treating device of claim 22, wherein the backing plate, the backing pad and the fastener structure are formed with a common bore equal to the inner diameter of the output tube and the diameter of the central hole formed in the surface treating arrangement.

24. The wet surface treating device of claim 18, including a cap cooperable with the upper end of the cylindrical sleeve to fix the cylindrical sleeve to the gearcase.

25. The surface treating device of claim 24, wherein the tubular pumping arrangement further includes an outer cylindrical tube slidably mounted in the cylindrical sleeve for movement between the cap and the bottom end of the cylindrical sleeve.

26. The surface treating device of claim 25, wherein the tubular pumping arrangement further includes an inner cylindrical tube disposed within and mounted for sliding movement together with the outer cylindrical tube relative to the cylindrical sleeve, the inner cylindrical tube defining a casing for a pump operable to permit the metered flow of surface treating liquid from the reservoir to the delivery tube and the bottom end of the cylindrical sleeve and the central hole formed in the surface treating arrangement.

27. The surface treating device of claim 26, wherein the inner cylindrical tube has an upper portion that extends upwardly through the cap and is removably secured to the actuating member, and a lower portion seated in the outer cylindrical tube and formed with a central opening generally aligned with the channel in the bottom end of the cylindrical sleeve.

28. The surface treating device of claim 27, wherein the pump includes a cylindrical cartridge having a restricted open upper end and a radially enlarged lower end formed with a first set of openings therein, an elongated tubular stem extending through the central opening in the lower portion of the outer cylindrical tube, the stem having a stub end projecting into the channel formed in the bottom end of the cylindrical sleeve, a stop member engageable against the bottom end of the cylindrical sleeve, a seat member normally engageable with the enlarged lower end to block communication of the first set of openings, a second set of openings provided in the stem beneath the seat member, a ball lodged in the restricted upper end and a spring interposed between the seat member and the ball for normally spacing the actuating member from the cap and biasing the seat member against the lower portion of the inner cylindrical tube and the stop member against the bottom end of the cylindrical sleeve, such that liquid introduced from the reservoir through the passageway to the interior of the inner cylindrical tube will be prevented from exiting therefrom due to the engagement of the seat member against the lower portion of the inner cylindrical tube, and moving the actuating member against the bias of the spring into engagement with the cap will cause sliding of the inner and outer cylindrical tubes relative to the cylindrical sleeve, as well as sliding of the cartridge along the stem such that liquid will flow through the first set of openings into the second set of openings through the stem and delivery tube to the central hole formed in the surface treating arrangement.

29. The surface treating device of claim 18, wherein the first gear is a pinion and the second gear is a ring gear.

30. The surface treating device of claim 18, wherein the side wall of the cylindrical sleeve is engageable with the upper bearing element.

31. The wet surface treating device of claim 18, wherein the motor is embodied in an electrically or battery powered drill.

32. The surface treating device of claim 19, wherein the reservoir is tiltably mounted about a ball joint extending upwardly from the actuating member.

33. The surface treating device of claim 18, including a power accessory attachment and auxiliary power equipment accessory attachment enabling power to be delivered to the auxiliary power equipment.

34. The surface treating device of claim 33, wherein the power accessory attachment includes at least one electrical receptacle in communication with a source of electrical power.

35. The surface treating device of claim 34, wherein the power accessory attachment includes a switch for selectively controlling power to the receptacle.

36. The surface treating device of claim 33, wherein the auxiliary power equipment is an incandescent lamp.

37. In a surface treating device having a driving mechanism for moving a primary surface treating arrangement having at least one through hole relative to a working surface, the improvement residing in:

an auxiliary surface treating arrangement non-rotatably mounted and having opposite ends extending into the one through hole in the primary surface treating arrangement for selectively providing auxiliary surface treatment relative to the working surface, the auxiliary surface treating arrangement being defined by a dispersing arrangement including a reservoir tiltably mounted relative to the driving mechanism for storing a supply of surface treating material therein, the dispensing arrangement being incorporated into the driving mechanism of the surface treating device for selectively pumping a quantity of surface treating material through the driving mechanism to the through hole of the primary surface treating arrangement.

* * * * *